US010910189B2

(12) United States Patent
Jing et al.

(10) Patent No.: US 10,910,189 B2
(45) Date of Patent: Feb. 2, 2021

(54) PORTABLE ACCELERATOR BASED X-RAY SOURCE FOR ACTIVE INTERROGATION SYSTEMS

(71) Applicant: Euclid Beamlabs, LLC, Solon, OH (US)

(72) Inventors: Chunguang Jing, Naperville, IL (US); Roman Kostin, Oak Park, IL (US); Ao Liu, Naperville, IL (US); Sergey Antipov, Naperville, IL (US); Alexei Kanareykin, Bethesda, MD (US)

(73) Assignee: Euclid Beamlabs, LLC, Solon, OH (US)

( * ) Notice: Subject to any disclaimer, the term of this patent is extended or adjusted under 35 U.S.C. 154(b) by 100 days.

(21) Appl. No.: 16/366,698

(22) Filed: Mar. 27, 2019

(65) Prior Publication Data

US 2020/0312602 A1 Oct. 1, 2020

(51) Int. Cl.
*H01J 35/14* (2006.01)
*H01J 35/16* (2006.01)

(52) U.S. Cl.
CPC ..... *H01J 35/14* (2013.01); *H01J 35/16* (2013.01)

(58) Field of Classification Search
CPC ..... A61N 5/1081; A61N 2005/1087; A61N 5/1067; A61N 5/10; A61N 5/1077; A61N 5/1082; A61N 2005/1097; A61N 5/1049; A61N 5/107; A61N 5/1044; A61N 5/1045; A61N 2005/1061; A61N 2005/1095; A61N 2005/1051; A61N 2005/1058; A61N 2005/1076; A61N 2005/1088; A61N 2005/1089; A61N 5/1043; A61N 5/1064; H01J 2235/08; H01J 2237/0815; H01J 35/02; H01J 37/141; H01J 37/3405;
(Continued)

(56) References Cited

U.S. PATENT DOCUMENTS 8,111,025 B2 2/2012 Whittum et al.
8,198,587 B2 * 6/2012 Whittum ..... G21K 1/093 250/306

(Continued)

OTHER PUBLICATIONS

Mitsuru Ueaska et al, Commissioning of portable 950 keV/3.95MeV X-band linac X-ray sources for on-site transmission testing, E-Journal of Advanced Maintenance, vol. 5-2 (2013) 93-100.

(Continued)

*Primary Examiner* — Irakli Kiknadze
(74) *Attorney, Agent, or Firm* — Maine Cernota & Rardin

(57) ABSTRACT

In embodiments, a linac electron beam excited X-ray source weighing less than 50 pounds, and having a volume less than 1 cubic foot, injects electrons from an RF-excited, diamond tip cathode into a dielectric accelerator tube of diameter less than 10 mm, where the electrons are RF-accelerated to 1-4 MeV. A focusing channel having a plurality of annular permanent magnets can surround the dielectric tube, and a vacuum can be maintained in the tube by a getter pump. The accelerating RF can be 10 GHz or higher. The X-ray source can be powered by a rechargeable battery for more than an hour. Embodiments can be transported within a case having a display attached to an interior surface of its lid. An X-ray head can be removed from the case and extended up to 10 feet while remaining interconnected with the case by a flexible conduit.

17 Claims, 4 Drawing Sheets

(58) Field of Classification Search
CPC ..... H01J 65/042; H01J 37/32055; H01J 37/3244; H01J 37/32633; H01J 37/3266; H01J 37/3402; H01J 37/3447; H01J 37/3458; H01J 25/02; H01J 35/14; H01J 35/00; H01J 35/16; H01J 2201/30449; H01J 2235/062; H01J 2235/068; H01J 35/025; H01J 35/04; H01J 35/045; H01J 35/065; H01J 35/116; H01J 35/153; H01J 35/186; G21K 1/046; G21K 1/093; G21K 5/04; G21K 1/02; G21K 1/00; G21K 5/00; G21K 5/10; G21K 2207/005; A61C 13/16; A61C 13/20; A61C 13/203; A61C 13/206; A61C 5/00; A61C 5/77; B01J 19/088; B01J 2219/0892; B01J 2219/0894; B01J 2219/0875; B01J 19/126; B01J 2219/0879; G01N 23/04; G01N 23/083; G01N 23/041; H05G 1/10; H05G 1/025; H05G 1/04; H05G 1/00; H05G 2/00; G01V 5/0016; G01V 3/30; G01V 5/12; G01V 5/0041; H05H 9/02; H05H 9/005; H05H 9/04; H05H 1/54; H05H 3/04; E21B 47/11; E21B 49/00; A61B 6/032; A61B 6/40; A61B 6/4007; A61B 6/405; A61B 6/4405; A61B 6/484
USPC ..... 378/119, 137, 138
See application file for complete search history.

(56) References Cited

U.S. PATENT DOCUMENTS

| | | | | |
|---|---|---|---|---|
| 9,671,520 | B2 * | 6/2017 | Botto | H05H 9/02 |
| 10,568,196 | B1 * | 2/2020 | Nguyen | H05H 7/02 |
| 2009/0140177 | A1 * | 6/2009 | Whittum | H01J 35/02 250/493.1 |

OTHER PUBLICATIONS

C. Jing et al, A Portable X-Ray Source Based on the Dielectric Accelerator, IPAC2018, Vancouver, BC, Canada, JACoW Publishing, ISBN: 978-3-95450-184-7.

Jiaqi Qiu et al, Nanodiamond Thin Film Field Emitter Cartidge for Miniature High-Gradient Radio Frequency X-Band Electron Injector, IEEE Transactions on Electron Devices, vol. 65, No. 3, Mar. 2018.

* cited by examiner

PORTABLE ACCELERATOR BASED X-RAY SOURCE FOR ACTIVE INTERROGATION SYSTEMS

STATEMENT OF GOVERNMENT INTEREST

Portions of the present invention may have been made in conjunction with Government funding under DHS SBIR Phase II Grant #HSHQDN-17-C-00007, and there may be certain rights to the Government.

FIELD OF THE INVENTION

The present invention relates to a systems and method for generating high energy X-ray beams, and more particularly to portable systems and methods for generating energetic electron driven X-ray beams.

BACKGROUND OF THE INVENTION

X-ray systems that are driven by electron linear accelerators ("linac"s) with electron beam powers of a few MeV are widely used for radiotherapy, cargo inspection, industrial radiography, active interrogation and non-destructive evaluation. The X-rays in these systems are produced by the Bremsstrahlung radiation that results when electrons with energy levels of between 100 keV and 5 MeV impact a radiation target, for example a tungsten film. These systems are typically very large and weigh several tons. As such, they are generally fixed in location.

Portable, low energy, linac-based X-ray sources would have attractive applications for non-destructive examination of the interiors of cargo and other objects, as an alternative to radiological gamma isotope sources. In a few cases, relocatable electron beam driven X-ray systems have been mounted on trucks so as to extend the reach of this technology into field applications such as bridge inspection. However, the RF power system (magnetron, modulator and cooler) for such conventional accelerators weighs at least 500 kg, and the accelerating structure, with shielding and X-ray target, weighs at least another 500 kg.

More recently, "man-portable" systems were introduced that comprise three modules, namely an "X-ray head" module, a "battery" module, and a "modulator" module, each of which weighs about 50 kg. As such, the entire system can be moved and assembled by two technicians. The X-ray heads for these systems are based on a traditional iris-loaded copper structure, which leads to an approximately 50 kg X-ray head module that only includes the accelerator and X-ray target, together with a collimator. Since the weight of the X-ray head module cannot be reduced any further, due to the weight of the accelerating structure and its shielding, this leaves no incentive to minimize the weight of the other two units. Instead, these man-portable systems maximize the beam power, while maintaining the weights of all three of the modules at around 50 kg.

What is needed therefore is a lightweight, low cost electron beam driven X-ray system that can be provided as a single module that can be carried by a technician, can fit into tight spaces, and can replace radioactive isotope—based devices in industrial radiography and other applications.

SUMMARY OF THE INVENTION

The present invention is a lightweight, low cost, battery-powered, electron beam driven X-ray system that can be provided as a single module, can be carried by a technician, and can fit into tight spaces. Embodiments are similar in size to low-energy X-ray systems, such as dental X-rays, but provide higher energy X-rays due to the implementation of linear accelerator ("linac") electron beams of at least one MeV. In some embodiments, the entire system, including the battery pack, modulator, magnetron, electron gun and accelerating structure can be fit into a suitcase and carried by a single person as a single unit. Various embodiments can replace radioactive isotopes as used for industrial radiography applications. Other potential applications include active interrogation systems and non-destructive evaluations, including in-line real-time NDT/NDE and monitoring of industrial targets and critical infrastructures located in narrow, restricted access spaces.

The reduction in size, weight, and power of the present invention is achieved in part by reducing the beam power of the electron beam to about 20 W, which is much less than the typical truck-mounted power level of approximately 1 kW. The kinetic energy of the electrons in the beam is maintained at a level of 1-4 MeV so that high energy X-rays can be produced that provide deep penetration, while the beam power is reduced by lowering the beam current to about 10-50 μA.

Instead of using a traditional all-metal electron accelerator structure, the present design implements a dielectric (ceramic) loaded accelerating structure, referred to herein as a "DLA." Because of its high dielectric constant (between 10 and 20), the transverse size of this DLA structure is less than 10 millimeters, i.e. comparable to the diameter of a pencil, which is an order of magnitude smaller than traditional, metallic designs.

While metal structures require periodic geometric features such as irises to produce an accelerating mode matched to the beam, the basic RF structure of the DLA as implemented in the present invention is very simple, and in embodiments comprises a cylindrical, dielectric tube with an axial vacuum channel that is inserted into a conductive sleeve. The dielectric constant and the inner and outer radii of the dielectric tube are chosen in various embodiments so as to match the phase velocity of the fundamental mode (referred to herein as the TM01 mode) at a selected frequency to the beam velocity, which is close to the speed of light. There is no need for a thick copper wall, which further reduces the overall weight of the structure. In addition, due to the small transverse size of the DLA, there is a huge reduction in the required bulk and weight of the lead shielding that surrounds the accelerator.

In addition, the reduced power requirement of the DLA further allows the "battery" and "modulator" to be re-optimized for lower size and weight, thereby enabling the entire system to be merged into a single, portable unit. In various embodiments of the invention, all of the other components which support the DLA are engineered to ensure their compactness, low power consumption, and light weight. These size- and weight-reducing features, in embodiments, include the use of a field emission "cold" cathode, use of a plurality of spaced-apart permanent magnets to form the focusing channel, maintenance of the DLA vacuum using getter pumps, and/or a distributed high voltage modulator, among others.

To achieve the 1-4 MeV electron beam energy, relatively high peak power RF is required. In embodiments of the present invention, the RF is applied at a high frequency, so that the weight and volume of the structure, which much correspond to the RF wavelength, can be proportionately reduced and scaled (roughly according to the inverse of the RF frequency). In embodiments, the RF frequency is 10

GHz or even higher. Note that the term "RF" is used herein to refer to microwaves as well as to traditional radio frequencies.

In an exemplary embodiment that includes a 1 MeV electron beam accelerator, the RF is applied at a frequency of about 10 GHz. This is a frequency for which high peak power is available, manufacturing tolerances are reasonable, and cell to cell coupling is not a problem (when specific tuning procedures are applied as discussed below). In some of these embodiments, an X-band 200-250 kW peak air traffic control radar magnetron is used as the RF source. The average power of this magnetron is only about 220 W, due to its low duty cycle. The magnetron efficiency is on the order of 40%, such that the modulator consumes about 600 W. Including overhead for cooling etc, the unit requires about 1 kW total power, which can be provided for 1 hour by a compact, roughly 7 kg Li-ion battery. The resulting system has a total volume of about one cubic foot and a weight of less than 100 pounds, and in embodiments equal to or less than about 50 pounds.

Embodiments of the invention combine some or all of the following advantages, as compared to prior approaches:

1) A dielectric DLA accelerator is implemented instead of a traditional all-metal electron accelerator structure.

2) There is no need of brazing in fabrication of the DLA. Instead, the RF coupler is made of stainless steel and then plated with copper to raise its quality factor ("Q"). The dielectric tube is metalized and soldered to a copper gasket. A stainless steel conflat ("CF") flange presses the copper gasket against the RF coupler to seal both the vacuum and the RF. The CF flange is also used to connect the beam source.

3) The field emission cathode and accelerator are integrated within one device, which uses a single microwave source to generate the electrons and then accelerate them to a high energy level before striking the radiation target. High current field emission cathodes, for example a diamond array cathode that contains thousands of diamond tips having largest dimensions of between 1-10 nm located in an area of more than 10 square millimeters, can produce large currents when high gradient electric fields from an external microwave source are applied to its surface. Embodiments of the present invention use the same microwave source both to generate the electrons from the diamond array cathode and to accelerate them in the DLA, so that the electrons are only emitted at times when they will also be accelerated. In contrast, the thermionic cathodes that are adopted by most low energy electron accelerators require a constant current source for heating up the filament, and thus continuously emit electrons regardless of whether microwaves are applied. This difference between the accelerator system of the present invention and traditional systems in embodiments is a feature that provides a higher "wall plug" efficiency than traditional approaches.

4) A high voltage pulser, also sometimes referred to as a "modulator" is a key component for enabling a magnetron to produce high power RF. These modulators are usually bulky and heavy. However, in embodiments of the present invention the modulator can be manufactured as a plurality of functional modules, thereby minimizing the weight and space of the pulsing system that drives the magnetron. These modules include one or more power supplies, a transformer, a solid state switch, a control circuit, and a multistage pulse forming network. All of these functional modules of this distributed modulator can be flexibly mounted in any orientation in order to achieve a desired compactness of the overall system design.

5) Most traditional, industrial, low energy electron accelerators implement an electrically energized solenoid magnet to focus and enhance the beam transportation over the acceleration distance. Instead, in embodiments of the present invention, a plurality of periodically spaced-apart permanent magnets surround the dielectric accelerator so as to focus the beam and improve its transmission rate. Due to the small transverse size of the DLA, permanent magnets such as rare earth magnets that are formed as rings having a thickness of only a few millimeters can be used to provide a very strong focusing force. This feature provides three advantages, in that the permanent magnets do not require any electricity (which is particularly important for battery powered embodiments), they are light weight, and they are transversely small.

6) After an initial vacuum pumping, which can be applied using a separate pumping station, maintenance of the vacuum of the entire accelerator system relies, in embodiments, on one or more getter pumps, which are compact, light, and do not consume any power once they are activated.

The present invention is an X-ray source that includes a dielectric accelerator. The dielectric accelerator includes an accelerator tube formed from a dielectric material and having an outer diameter of less than 1 cm, the accelerator tube having a low energy input and a high energy output, said low energy input being in vacuum communication with a cathode configured to emit electrons and being configured to accept electrons emitted from the cathode.

The X-ray source further includes a magnetic focusing channel surrounding the accelerator tube, and an RF source configured to apply RF energy to the accelerator tube, said RF energy having a mode and phase velocity configured to cause the electrons emitted by the cathode to be accelerated so as to become high energy electrons of between 100 keV and 4 MeV as they travel within the accelerator tube from the low energy input to the high energy output.

The X-ray source further includes a target in vacuum communication with the high energy output of the accelerator tube and configured to emit X-rays when impacted by the high energy electrons, and a power supply configured to provide all power requirements of the X-ray source. The X-ray source has a total weight of less than 100 pounds.

In embodiments, the X-ray source has a total weight of not more than 50 pounds.

In any of the above embodiments, the X-ray source can have a total volume of not more than two cubic feet. And in some of these embodiments, the X-ray source has a total volume of not more than one cubic foot.

Any of the above embodiments can further include a case configured to contain the entire X-ray source in a storage configuration. In some of these embodiments the accelerator tube is included in an X-ray head module, which can be removed from the case while retaining interconnections through a flexible conduit with a remaining portion of the X-ray source in the case. In any of these embodiments, the case can include a display affixed to an interior surface of a lid of the case.

In any of the above embodiments, the electrons emitted by the cathode can be accelerated so as to become high energy electrons of at least 1 MeV as they travel within the accelerator tube.

In any of the above embodiments, the power supply can be a rechargeable battery, and the X-ray source can further comprises a modulator configured to convert energy from the battery into high voltage pulses directed to the RF source.

In any of the above embodiments, the cathode can include a plurality of diamond tips having largest dimensions of between 1-10 nm, said diamond tips being configured to emit electrons when irradiated by RF energy from the RF source.

In any of the above embodiments, the magnetic focusing channel can include a plurality of annular permanent magnets surrounding the accelerator tube.

Any of the above embodiments can further include a getter pump configured to maintain a vacuum within the accelerator tube.

In any of the above embodiments, the accelerator tube can have an interior diameter that is uniform, and an exterior diameter that is varied along its length in a manner that tends to maintain a match between the phase velocity of the applied RF within the accelerator tube and the electrons as they are accelerated through the accelerator tube by the applied RF.

In any of the above embodiments, an entire outer surface of the accelerator tube can be metalized. In some of these embodiments vacuum and electromagnetic seals are provided at both the input and output ends of the accelerator tube without braised joints.

In any of the above embodiments, the RF energy applied by the RF source to the accelerator tube can have an RF frequency of at least 10 GHz.

And in any of the above embodiments, the RF source can include an X-band 200-250 kW peak air traffic control radar magnetron.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

As discussed above, the present invention is a lightweight, low cost, battery-powered, electron beam linear accelerator ("linac") driven X-ray system that can be provided as a single module, can be carried by a technician, and can fit into tight spaces.

Figure 1B:
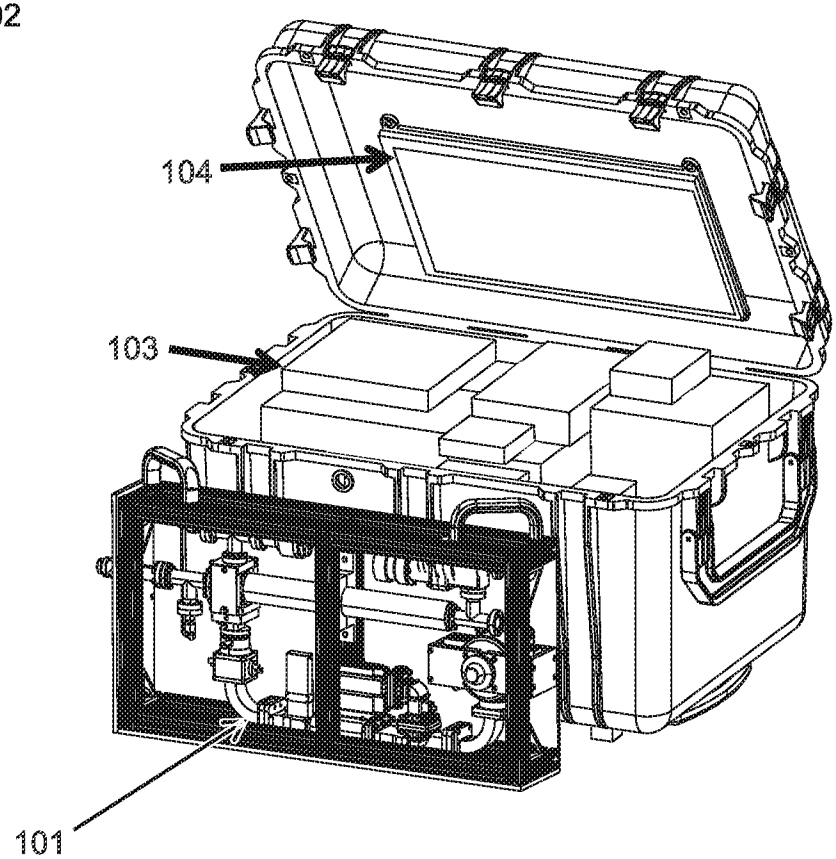
FIG. 1B is a perspective view drawn to scale of the embodiment of FIG. 1A shown with the X-ray head module removed and placed in front of the suitcase.
Figure 1A:
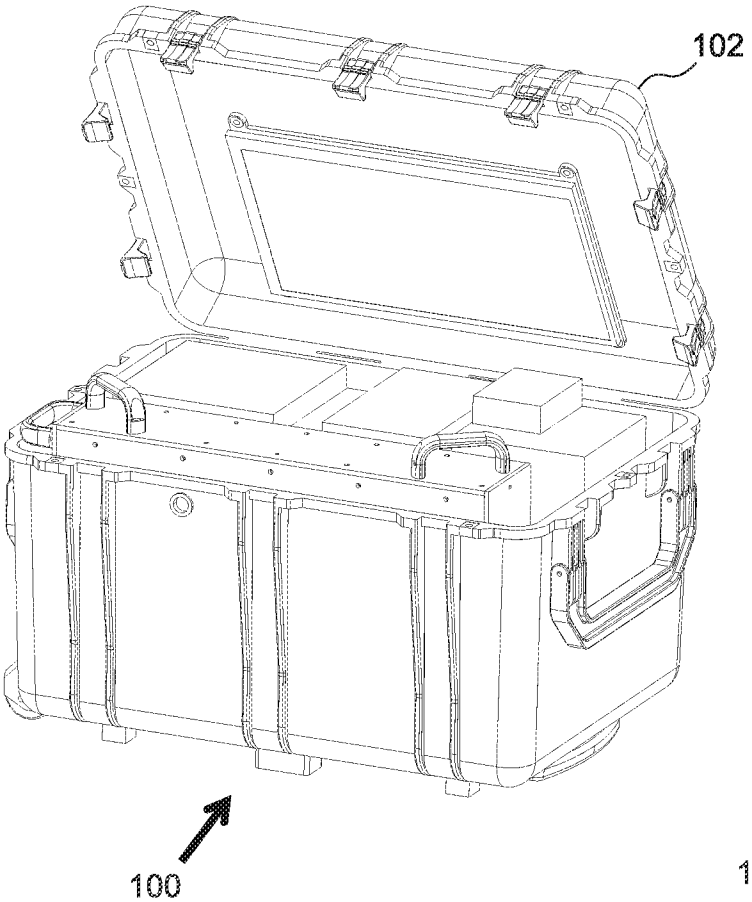
FIG. 1A is a perspective view drawn to scale of an embodiment of the present invention shown packed in a suitcase.

FIG. 1A is a perspective view that illustrates an embodiment of the X-ray system (100) of the present invention in its "storage" mode, whereby the entire X-ray system is contained in one reusable, transportable case that can be carried by a single person, referred to herein generically as a "suitcase" 102, whereas FIG. 1B is a perspective view of the same embodiment when configured in its operation mode, wherein the X-ray "head" assembly (101), which includes the DLA and is separately housed, has been removed from the suitcase 102 so that it can be placed near the target (not shown). The X-ray head 101 is linked to the other, "supporting" modules 103 of the system, which remain inside the suitcase 102, via a long, soft cable (not shown) which provides the high voltage that is required by the X-ray head 101. The supporting modules (103) inside the suitcase 102 include the high voltage modulator, the control unit, and the battery pack, among others. A display unit (104) is mounted inside of the lid of the suitcase 102.

Figure 2:
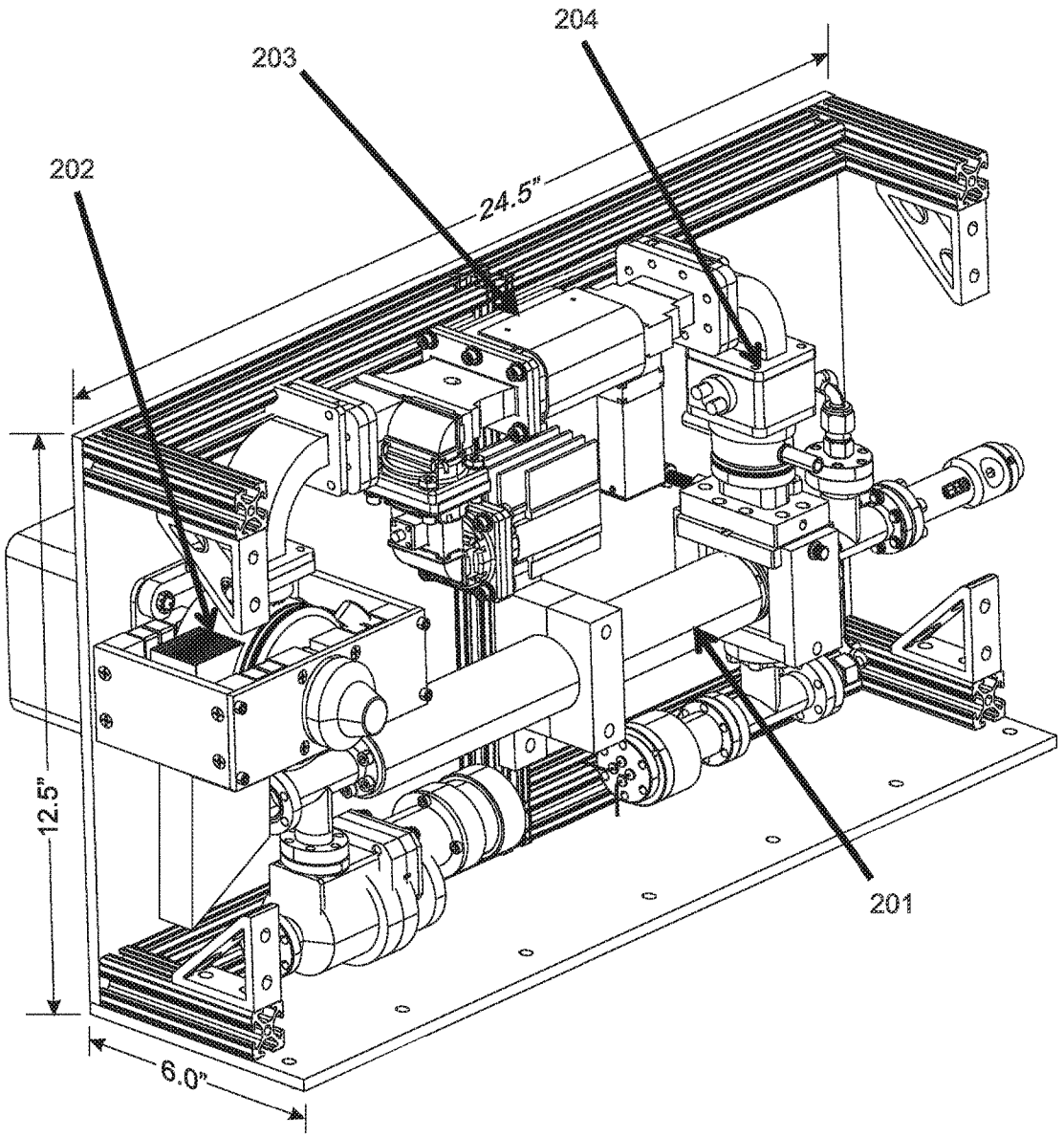
FIG. 2 is a perspective view drawn to scale of a compact X-ray head module according to an embodiment of the invention that includes a DLA.

Referring to FIG. 2, the portable X-ray head (101) includes a low energy dielectric accelerator assembly (201), referred to herein as a "DLA," as well as a magnetron (202) that provides high power RF pulses to drive the DLA. A circulator (203) is installed at the output of the magnetron to protect the magnetron from damage in case it is subject to a full power reflection out of the DLA, for example during the rising and falling edges of an RF pulse, or due to an RF breakdown during operation. The X-ray head (101) further includes a compact directional coupler that monitors the forwarding and reflected RF pulse signal.

The RF pulses that are produced by the magnetron (202) cause the electrons that are emitted from the cathode 307 of the DLA (201) to gain kinetic energy as they pass through the DLA. Once the energetic electrons reach the exit of the DLA, they are stopped by a thin film target (not shown) made of a selected material or materials, which can be or can include tungsten and/or titanium. The collision of the energetic electrons with the atoms of the target material create an X-ray flux, which is known as Bremsstrahlung radiation.

Figure 3:
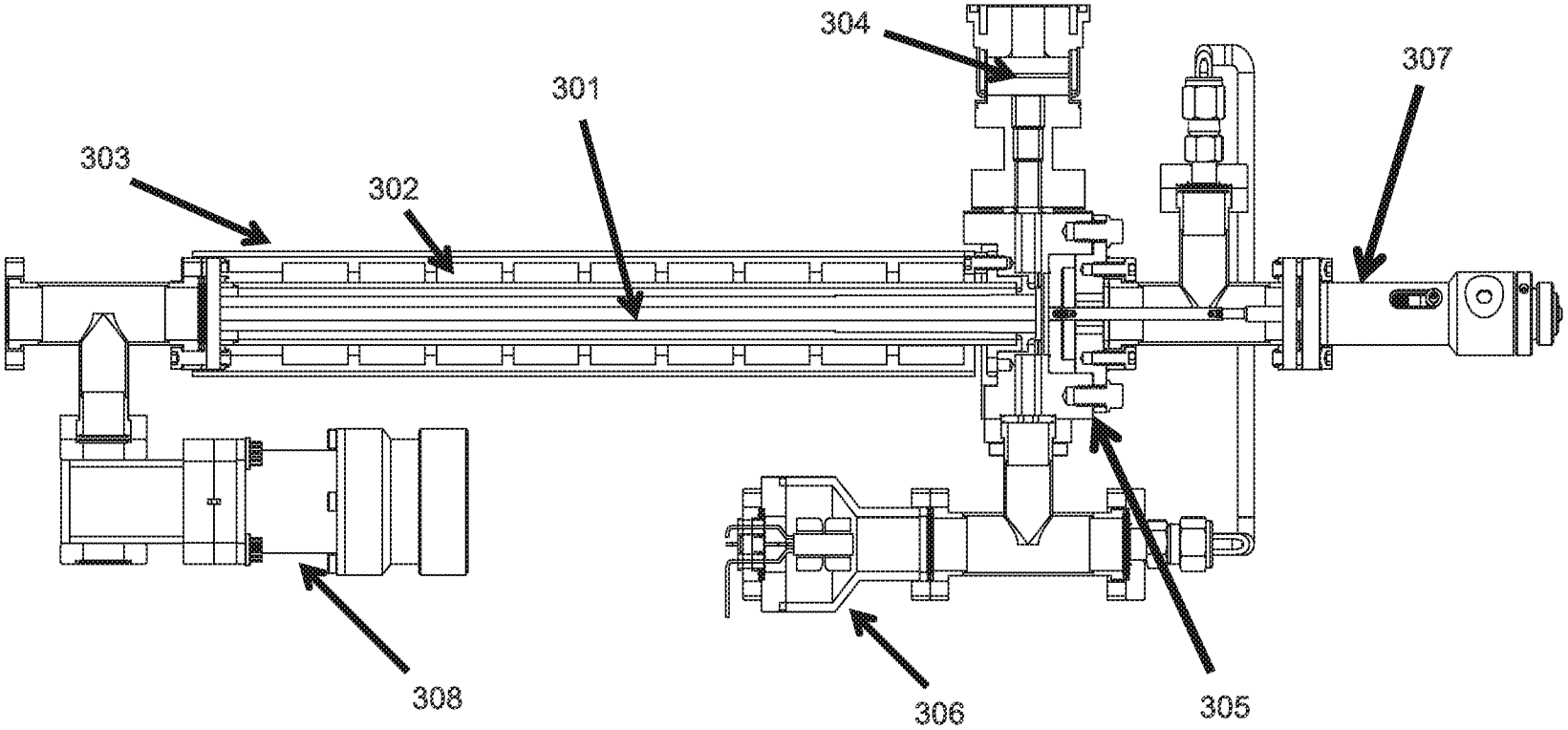
FIG. 3 is a sectional view drawn to scale of a cathode integrated, brazeless, low energy dielectric accelerator (DLA) in an embodiment of the invention.

Referring to FIG. 3, the low energy dielectric accelerator assembly (201) ("DLA") includes a standing wave dielectric tube (301), a focusing channel (302) surrounding the dielectric tube that includes a plurality of spaced apart permanent magnets, a shielding and support pipe (303), a high power RF window (304), an RF coupler (305), a getter pump (306), a cathode insert (307), and a vacuum gate (308).

Embodiments include any combination of several power saving features that help to reduce size, weight, and power requirements, so that the embodiment can be deployed as a battery powered unit without an external power supply. For example, the cathode which emits the electrons can be a field emission cathode that incorporates a plurality of diamond tips, each of which has a largest dimension of between 1 and 10 nanometers. When high power RF is applied to the cathode, the diamond tips continuously emit electrons. As such, no external heating element is needed to create the cathode electron emissions, as would be the case with a conventional, thermally heated cathode. Furthermore, the emitted electrons are naturally emitted in concentrated bursts that are spaced apart according to the period of the applied RF waves, and therefore enter the DLA only when the RF is present and able to accelerate them. In embodiments, the cathode is part of a cathode insert (307), which is designed in embodiments to be easily replaceable when it wears out.

The focusing channel 302 reduces beam losses at the initial stages of acceleration. Rather than implementing one or more electrically excited solenoids to guide the electron beam through the dielectric accelerator, which is the traditional approach, embodiments of the present invention reduce power consumption by implementing a focusing channel (302) that includes a series of periodically spaced-apart, annular permanent magnets that surround the accelerator tube, and generate a strong magnetic focusing field without requiring any electrical power. Implementation of this permanent magnet focusing channel is rendered feasible and cost-effective due to the significant reduction in transverse size of the DLA, as compared to traditional metallic accelerators.

Initially, the vacuum within the DLA is established, for example during its manufacture, by using an external pumping station, after which the gate (308) is closed. At that point, a getter pump (306), which does not require power once it is activated, is used to maintain the vacuum inside the DLA.

The RF coupler (305) is used to efficiently convert the electromagnetic mode in the waveguide into the accelerating mode in the DLA. In embodiments, the RF coupler also includes two accelerating gaps that rapidly extract electrons from the cathode and accelerate them to the injection energy that the DLA requires.

Figure 4B:
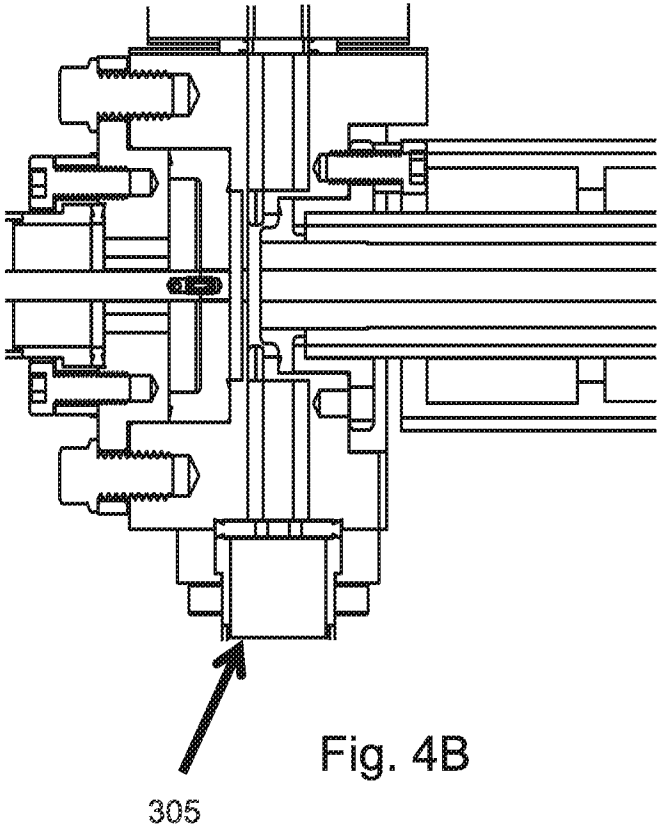
FIG. 4B is a magnified sectional view drawn to scale of a portion of the view of FIG. 3, shown as inverted about the vertical axis for better comparison with FIG. 4A.
Figure 4A:
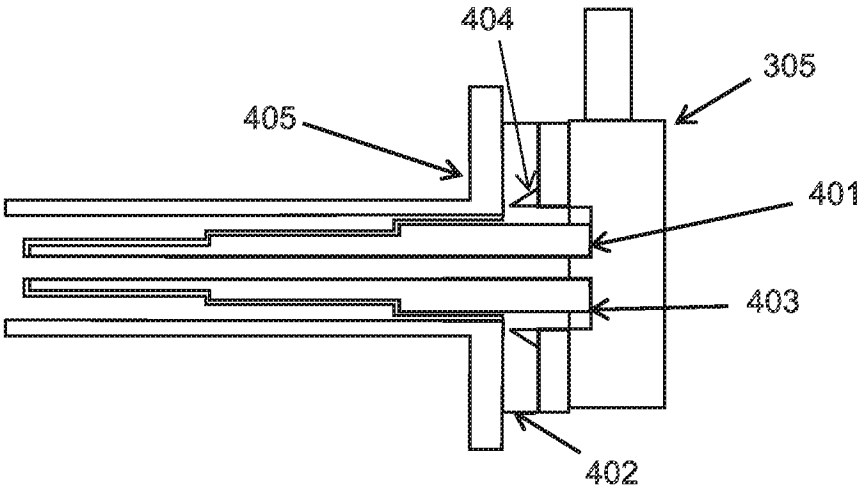
FIG. 4A is a cross sectional drawing that illustrates the implementation of a vacuum seal without a brazed joint in embodiments of the present invention.

With reference to FIG. 4A, in embodiments the vacuum seal of the DLA can be established without using a brazing process. Instead, the outer surface of the dielectric tube (401) is metalized, usually by copper, except the end surface at the lower energy side (which has a thicker dielectric wall). The lower energy side is then soldered to a copper gasket (402) using a low temperature solder at around 200° C. The solder joint is sealed at the tip of the gasket (403), which is inserted into the RF coupler (405) so as to couple the electromagnetic waves from the coupler into the dielectric tube 401, and also so as to accept the injected electrons from the cathode. A knife edge (404) is formed at the RF coupler side. When the metal tube of the RF coupler (405) is pushed against the copper gasket 402 during assembly, the knife edge bites into the copper gasket 402 to seal the vacuum.

FIG. 4B is a magnified sectional view drawn to scale of a portion of the view of FIG. 3, shown as inverted about the vertical axis for better comparison with FIG. 4A.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the invention is not limited to just these forms, but is amenable to various changes and modifications without departing from the spirit thereof. The disclosure presented herein does not explicitly disclose all possible combinations of features that fall within the scope of the invention. The features disclosed herein for the various embodiments can generally be interchanged and combined into any combinations that are not self-contradictory without departing from the scope of the invention. In particular, the limitations presented in dependent claims below can be combined with their corresponding independent claims in any number and in any order without departing from the scope of this disclosure, unless the dependent claims are logically incompatible with each other.

We claim:

1. An X-ray source comprising:

a cathode configured to emit electrons when RF energy is applied to the cathode;

a dielectric accelerator comprising:

an accelerator tube formed from a dielectric material and having an outer diameter of less than 10 mm, the accelerator tube having a low energy input and a high energy output, said low energy input being in vacuum communication with the cathode and being configured to accept the electrons emitted from the cathode;

a magnetic focusing channel surrounding the accelerator tube;

an RF source configured to apply RF energy to the accelerator tube, said RF energy having a mode and phase velocity configured to cause the electrons emitted by the cathode to be accelerated so as to become high energy electrons of between 100 keV and 4 MeV as they travel within the accelerator tube from the low energy input to the high energy output, said RF energy being applied by the RF source simultaneously to the cathode and to the accelerator tube, so that the electrons are emitted by the cathode only when they will also be accelerated within the accelerator tube;

a target in vacuum communication with the high energy output of the accelerator tube and configured to emit X-rays when impacted by the high energy electrons; and a power supply configured to provide all power requirements of the X-ray source;

the X-ray source having a total weight of less than 100 pounds.

2. The X-ray source of claim 1, wherein the X-ray source has a total weight of not more than 50 pounds.

3. The X-ray source of claim 1, wherein the X-ray source has a total volume of not more than two cubic feet.

4. The X-ray source of claim 1, wherein the X-ray source has a total volume of not more than one cubic foot.

5. The X-ray source of claim 1, further comprising a case configured to contain the entire X-ray source in a storage configuration.

6. The X-ray source of claim 5, wherein the accelerator tube is included in an X-ray head module, which is configured to be removed from the case while retaining interconnections through a flexible conduit with a remaining portion of the X-ray source in the case.

7. The X-ray source of claim 5, wherein the case comprises a display affixed to an interior surface of a lid of the case.

8. The X-ray source of claim 1, wherein the X-ray source is configured to accelerate electrons emitted by the cathode so that the electrons become high energy electrons of at least 1 MeV as they travel through the accelerator tube.

9. The X-ray source of claim 1, wherein the power supply is a rechargeable battery, and the X-ray source further comprises a modulator configured to convert energy from the battery into high voltage pulses directed to the RF source.

10. The X-ray source of claim 1, wherein the cathode comprises a plurality of diamond tips having largest dimensions of between 1-10 nm, said diamond tips being configured to emit electrons when irradiated by the RF energy from the RF source.

11. The X-ray source of claim 1, wherein the magnetic focusing channel comprises a plurality of annular permanent magnets surrounding the accelerator tube.

12. The X-ray source of claim 1, further comprising a getter pump configured to maintain a vacuum within the accelerator tube.

13. The X-ray source of claim 1, wherein the accelerator tube has an interior diameter that is uniform, and an exterior diameter that is varied along its length in a manner that is configured to maintain a match between the phase velocity of the applied RF within the accelerator tube and the electrons as they are accelerated through the accelerator tube by the applied RF.

14. The X-ray source of claim 1, wherein an entire outer surface of the accelerator tube is metalized.

15. The X-ray source of claim 14, wherein vacuum and electromagnetic seals are provided at both the input and output ends of the accelerator tube without braised joints.

16. The X-ray source of claim 1, wherein the RF energy applied by the RF source to the accelerator tube has an RF frequency of at least 10 GHz.

17. The X-ray source of claim 1, wherein the RF source includes an X-band 200-250 kW peak air traffic control radar magnetron.

* * * * *